US010730304B2

(12) United States Patent
Fielder et al.

(10) Patent No.: US 10,730,304 B2
(45) Date of Patent: Aug. 4, 2020

(54) METHOD OF IMPROVING PRINTHEAD DECAP PERFORMANCE

(71) Applicant: Memjet Technology Limited, Dublin (IE)

(72) Inventors: Simon Fielder, North Ryde (AU); David Tyvoll, San Diego, CA (US); Jingyi Zhou, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 16/110,592

(22) Filed: Aug. 23, 2018

(65) Prior Publication Data

US 2019/0061355 A1 Feb. 28, 2019

Related U.S. Application Data

(60) Provisional application No. 62/549,382, filed on Aug. 23, 2017.

(51) Int. Cl.
*B41J 2/165* (2006.01)

(52) U.S. Cl.
CPC ..... *B41J 2/16552* (2013.01); *B41J 2/16517* (2013.01); *B41J 2/16535* (2013.01); *B41J 2/16585* (2013.01); *B41J 2002/1655* (2013.01); *B41J 2002/16558* (2013.01)

(58) Field of Classification Search
CPC ..... B41J 2/16552; B41J 2/16517; B41J 2/16535; B41J 2002/16558; B41J 2002/1655; B41J 2/16585; C11D 1/72; C11D 3/245
See application file for complete search history.

(56) References Cited

U.S. PATENT DOCUMENTS 5,905,514 A * 5/1999 Rhoads ..... B41J 2/16552 347/33
2005/0200649 A1* 9/2005 Yamaguchi ..... B41J 2/16552 347/21
2007/0279451 A1* 12/2007 Mizoguchi ..... B41J 2/16538 347/33

* cited by examiner

*Primary Examiner* — Geoffrey S Mruk
(74) *Attorney, Agent, or Firm* — Cooley LLP

(57) ABSTRACT

A method of inhibiting evaporation of water from inkjet nozzles of a printhead. The method includes the steps of: providing a wiping material infused with a liquid composition comprising an evaporation inhibitor; and wiping the wiping material over a nozzle plate of the printhead. The evaporation inhibitor is transferred to the nozzle plate during wiping and thereby inhibits evaporation of water from the inkjet nozzles.

9 Claims, 2 Drawing Sheets

METHOD OF IMPROVING PRINTHEAD DECAP PERFORMANCE

CROSS-REFERENCE TO RELATED APPLICATIONS

This application claims priority to and the benefit of U.S. Provisional Patent Application No. 62/549,382 entitled METHOD OF IMPROVING PRINTHEAD DECAP PERFORMANCE, filed Aug. 23, 2017, the disclosure of which is incorporated herein by reference in its entirety.

FIELD OF THE INVENTION

This invention relates to a method of improving printhead decap performance. It has been developed primarily for increasing a period in which printheads may be left uncapped without impacting ink formulations or printing performance.

BACKGROUND OF THE INVENTION

Pagewide inkjet printers employing Memjet® technology are commercially available for a number of different printing formats, including desktop printers, wideformat printers and digital presses. Pagewide printheads typically comprise thousands of microscopic inkjet nozzles, each of which needs to be available for droplet ejection on demand.

Inkjet nozzles must be maintained in a hydrated state in order to function properly. Evaporation of water through the nozzle during uncapped idle periods causes the nozzle to become clogged with a viscous plug of dehydrated ink components (a phenomenon known in the art as "decap"). Dehydrated nozzles blocked with viscous material may be unable to eject a droplet of ink in response to a fire signal. Even if a dehydrated nozzle is still able to eject ink in response to a fire signal, the ejected droplet may be misdirected, have a reduced droplet volume or a reduced ejection velocity, any of which may lead to a reduction in print quality. A period of time in which an uncapped nozzle becomes too dehydrated to eject ink properly is known in the art as the "decap time".

Inkjet printers usually employ a number of strategies for maintaining healthy nozzles. Typically, this involves a maintenance cycle in which nozzles are wiped and then capped to maintain a humid environment over the nozzles. Periodic ink ejections ("spitting") may also be used to maintain healthy nozzles. Spitting strategies require a nozzle to eject ink periodically on a timescale shorter than the decap time to avoid a viscous plug forming in the nozzle. Spitting may be performed, for example, during a maintenance cycle, between printing of media sheets or onto print media. For example, U.S. Pat. No. 7,246,876, the contents of which are incorporated herein by reference, describes printing a low-density keep-wet pattern onto a media substrate to ensure that each nozzle of the printhead is fired within a time period less than a decap time of the nozzle.

Notwithstanding some of these strategies for maintaining nozzle health, it would be desirable to increase the decap time of printheads, especially pagewide printheads. One approach to increasing decap times is to formulate inks with certain additives, which inhibit water evaporation from the nozzles. For example, U.S. Pat. No. 8,573,762 describes the use of certain polyurethanes in inks for increasing decap times. However, a problem with incorporating evaporation inhibitors into inks is that the evaporation inhibitor necessarily impacts on the ink properties. Evaporation inhibitors typically have relatively low solubility in inks and may compromise the balance of properties required to formulate an aqueous inkjet ink.

It would therefore be desirable to provide a method of increasing printhead decap times, which does not affect ink formulations.

SUMMARY OF THE INVENTION

In a first aspect, there is provided a method of inhibiting evaporation of water from inkjet nozzles of a printhead, the method comprising the steps of:

providing a wiping material infused with a liquid composition comprising an evaporation inhibitor; and wiping the wiping material over a nozzle plate of the printhead, wherein at least some of the evaporation inhibitor is transferred to the nozzle plate during wiping and thereby inhibits evaporation of water from the inkjet nozzles.

Advantageously, the evaporation inhibitor transferred onto the nozzle plate forms a film over nozzle openings in the nozzle plate and minimizes evaporation of water from ink contained in inkjet nozzles.

Examples of suitable evaporation are described in more detail below.

Preferably, the liquid composition comprises one or more ingredients selected from the group consisting of co-solvents and surfactants. Suitable co-solvents and surfactants for aqueous compositions are well known to the person skilled in the art and are described in, for example, U.S. Pat. No. 9,725,609, the contents of which are incorporated herein by reference. Examples of suitable co-solvents include, for example, glycols (e.g. ethylene glycol, diethyelene glycol, triethylene glycol etc.), glycol ethers, sulfolane, glycerol, trimethylolpropane, 2-pyrrolidone and N-methylpyrrolidone.

Preferably, the wiping material is comprised of a microfiber material mounted on a printhead wiper.

In one embodiment, the wiping material is wiped longitudinally along the printhead. Alternatively, the wiping material may be wiped laterally across the printhead.

Preferably, the printhead is a pagewide inkjet printhead.

In a second aspect, there is provided an apparatus for wiping a printhead comprising:

- a carriage comprising a maintenance drum mounted thereon, the maintenance drum having a dispensing nozzle;
- a web of wiping material having a wiping portion positioned over the dispensing nozzle;
- a liquid container in fluid communication with the dispensing nozzle;
- a dispensing system for dispensing liquid through the nozzle so as to infuse the portion of the wiping material with the liquid; and
- a carriage traversing mechanism for traversing the carriage longitudinally along the printhead so as to wipe the printhead and transfer the liquid onto the printhead.

The liquid may be any suitable functional fluid, such as a cleaning fluid or an evaporation inhibitor.

Preferably, the liquid comprises an evaporation inhibitor.

Preferably, the evaporation inhibitor is selected from the group consisting of: $R^a—(OCH_2CH(R^b))_n—OH$, $C_{10-30}$ hydrocarbons and $C_{10-30}$ hydrocarbyl ethers, wherein $R^a$ is $C_{10-30}$ hydrocarbyl, $R^b$ is selected from the group consisting of hydrogen and methyl, and n is an integer from 1 to 50.

Preferably, the apparatus further comprises a web advancement mechanism for advancing the web past the dispensing nozzle.

As used herein, the term "printer" refers to any printing device for marking print media, such as conventional desktop printers, label printers, duplicators, copiers and the like.

As used herein, the term "ink" refers to any printable fluid, including conventional dye-based and pigment-based inks, infrared inks, UV curable inks, 3D printing fluids, biological fluids, colorless ink vehicles etc.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
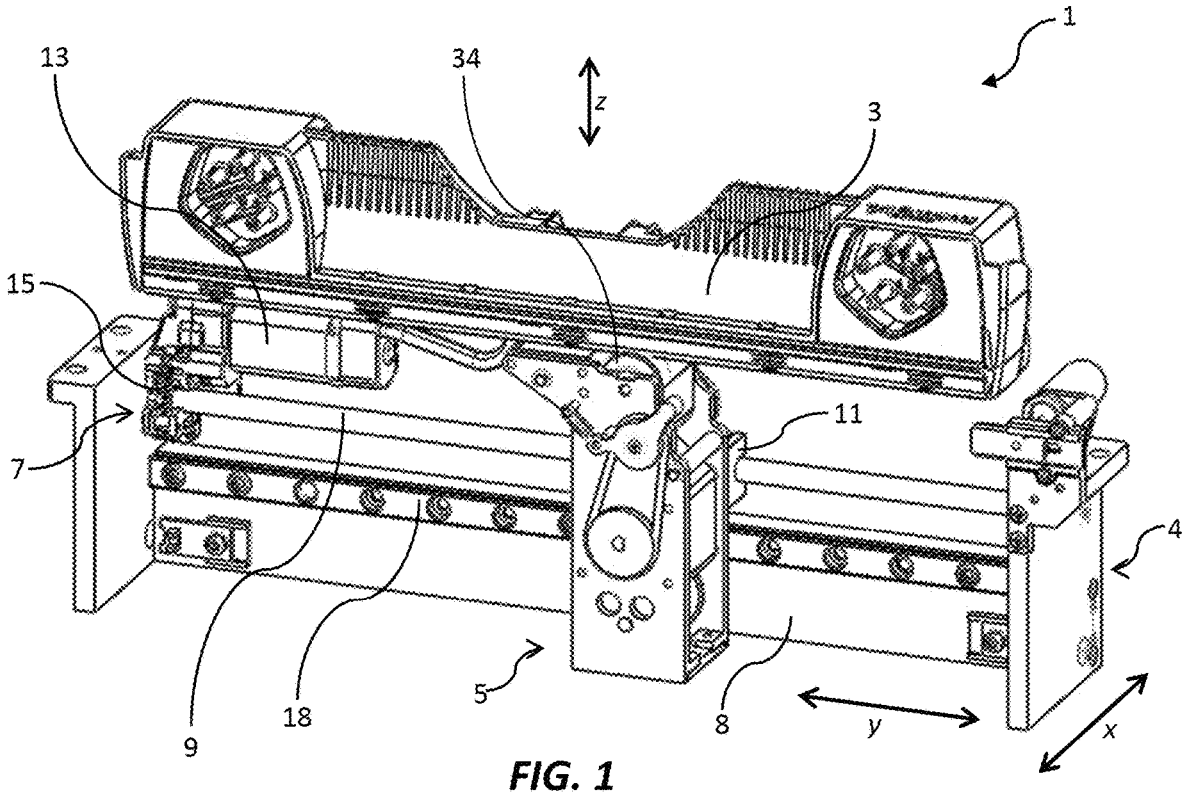
FIG. 1 shows a printhead and printhead wiper assembly.

Referring to FIG. 1, there is shown a wiping assembly 1 for wiping an elongate inkjet printhead 3 having a plurality of inkjet nozzles (not shown) extending along a length thereof. The wiping assembly 1 comprises a wiper carriage 5, which is moveable longitudinally along the length of the printhead 3 by means of a carriage traversing mechanism 7. The carriage traversing mechanism 7 comprises a rotatable threaded lead screw 9 extending a length of the printhead. The lead screw 9 is received by a lead bracket 11 fixed to the wiper carriage 5 to provide translating movement of the carriage when the lead screw is rotated. As will be readily appreciated by those skilled in the art, the lead bracket 11 has a complementary threaded portion (not shown) for mating with the threaded lead screw 9.

The lead screw 9 is rotated by means of a traversing motor 13 operatively connected to the lead screw via a gear wheel assembly 15 positioned at one end of the lead screw. Hence, the wiper carriage 5 travels along the length of the printhead 3 in a forward direction (left-to-right as shown in FIG. 1) by actuation of the traversing motor 13. Reversing the traversing motor 13 causes the carriage 5 to travel in an opposite direction.

A maintenance chassis 4 supports the carriage traversing mechanism 7 and wiper carriage 5, as well as a track 18 for guiding the carriage longitudinally along the printhead 3. The maintenance chassis 4, together with all supported components of the wiping assembly 1, is typically reciprocally moveable relative to the printhead 3 in a direction indicated by arrow y and/or a direction indicated by arrow x. This enables, for example, the printhead 3 to be capped during idle periods or positioned over a platen for printing. A suitable mechanism for laterally moving the maintenance chassis 4 along the directions indicated by arrows x and y is described in U.S. Pat. No. 8,616,678, the contents of which are incorporated herein by reference. A suitable mechanism for laterally moving the maintenance chassis 4 along the direction indicated by arrow x is described in U.S. patent application Ser. No. 14/473,806, the contents of which are incorporated herein by reference. These and other mechanisms for laterally moving the maintenance chassis 4 relative to the printhead 3 will be readily apparent to the person skilled in the art.

The maintenance chassis 4 may additionally support a cap (not shown) for capping the printhead, as described in U.S. Pat. No. 8,616,678 and U.S. patent application Ser. No. 14/473,806. It will be appreciated that sliding movement of the maintenance chassis 4 along the x-axis may be used to present either the wiper carriage 5 or a cap (not shown) to the printhead 3. In some embodiments, the maintenance chassis may support other components, such as a spittoon (e.g. a spittoon roller) or a platen.

Figure 2:
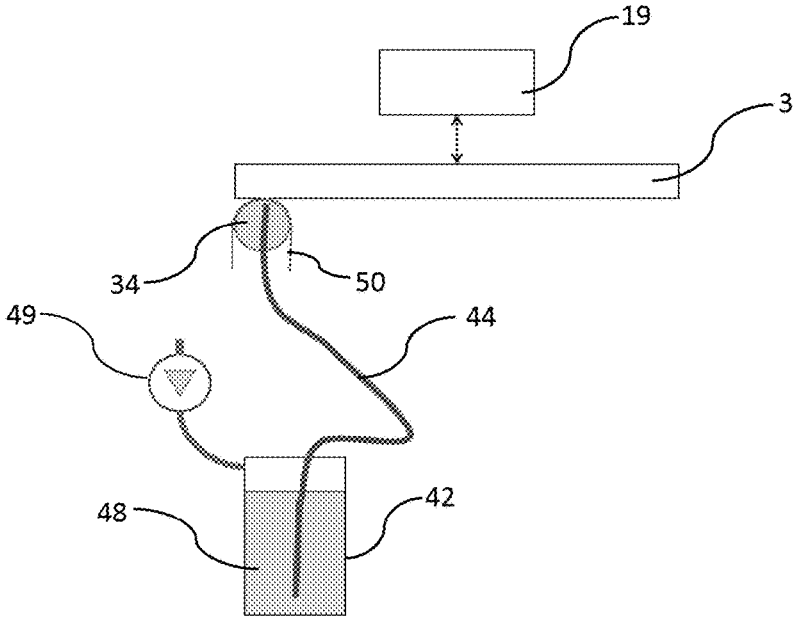
FIG. 2 shows schematically an arrangement for infusing a wiping material.

Referring to FIGS. 1 and 2, the printhead 3 is operatively engaged with a lift mechanism 19 for reciprocally lifting and lowering the printhead relative to the maintenance chassis in the direction indicated by arrow z. As described in U.S. Pat. No. 8,616,678, the printhead 3 may be positioned in a maintenance position as shown in FIG. 1, a transition position in which the printhead is lifted away from the wiper carriage 5, and a printing position in which the printhead is lowered below the maintenance chassis 4 so as to be positioned over a suitable platen (not shown). The lift mechanism 19 is shown only schematically in FIG. 2, although it will be appreciated that any suitable lift mechanism, such as a rack-and-pinion lift mechanism or a scissor lift, may be employed in the present invention.

Figure 3:
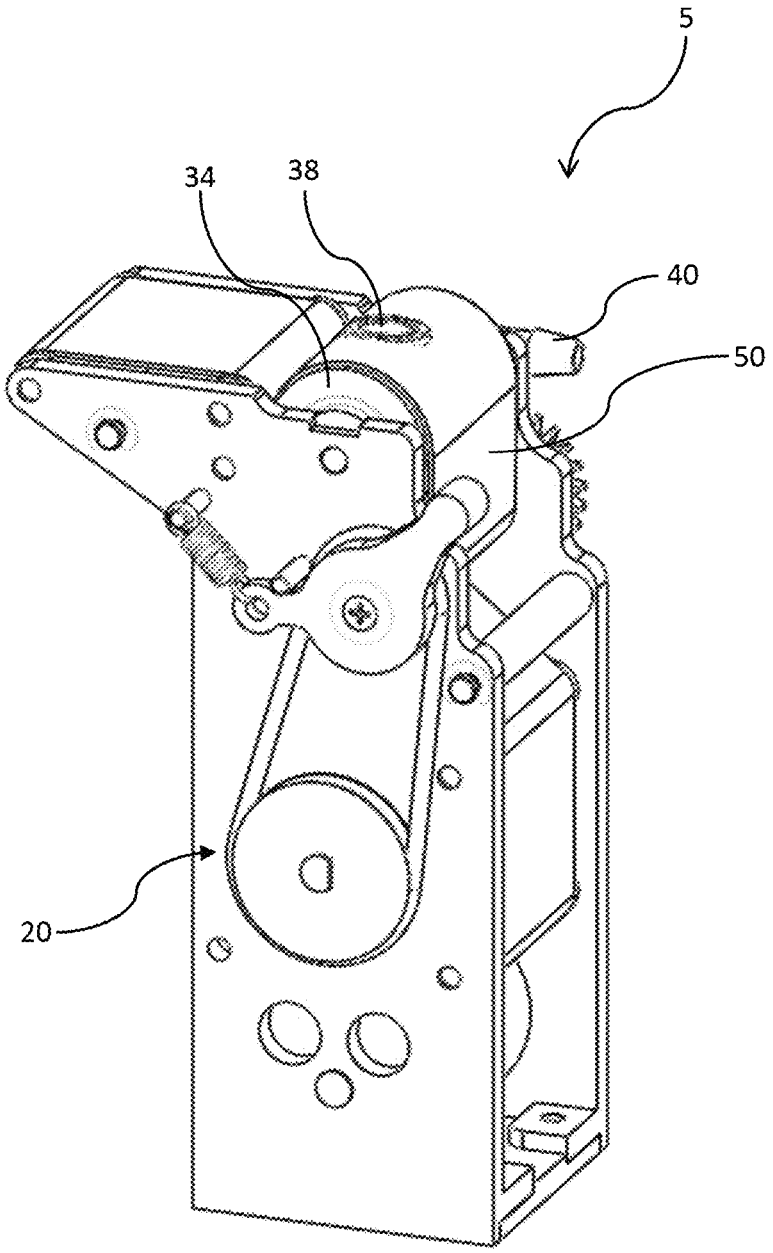
FIG. 3 shows a wiper carriage.

Turning to FIGS. 2 and 3, the wiper carriage 5 comprises a wiping member 34 in the form of a drum having a fluid dispensing nozzle 38. A microfiber web of wiping material 50 is mounted over the wiping member 34 for wiping the printhead 3. The fluid dispensing nozzle 38, which is positioned beneath the wiping material 50, receives fluid from a fluid inlet port 40, which is in turn connected to a fluid container 48 via a fluid line 44. The fluid container 48 contains a liquid 42 comprising an evaporation inhibitor, such as those described hereinbelow. In use, the liquid 42 is delivered to the fluid dispensing nozzle 38 via the fluid line 44 using any dispensing system, such as a pump 49 for pressurizing a headspace of the fluid container. In this way, the wiping material can be infused with the liquid 42 comprising the evaporation inhibitor.

The web of wiping material 50 is mounted between a pair of spools and the wiper carriage 5 comprises a web advancement mechanism 20 for advancing a portion of the wiping material past the wiper member 34 after a predetermined number of wipes of the printhead 3. Accordingly, fresh wiping material 50 infused with the liquid 42 may be presented to the printhead 3 for successive wipes when required.

It will be appreciated that one means of infusing a wiping material has been described above by way of example only. However, other means of infusing a wiping material (e.g. dip-coating, spraying etc.) will be readily apparent to the person skilled in the art and the present invention is not intended to be limited to any particular means of infusing the wiping material.

Evaporation Inhibitors

Evaporation inhibitors suitable for use in the present invention include compounds of formula: $R^a$—$(OCH_2CH(R^b))_n$—OH, wherein $R^a$ is $C_{10-30}$ hydrocarbyl, $R^b$ is selected from the group consisting of hydrogen and methyl, and n is an integer from 1 to 50. In one embodiment, the evaporation inhibitor is a polyoxyethylene ether, such as polyoxyethylene (2) stearyl ether, polyoxyethylene (4) stearyl ether, polyoxyethylene (10) stearyl ether, polyoxyethylene (10) cetyl ether, or combinations thereof.

Other examples of suitable evaporation inhibitors include $C_{10-30}$ hydrocarbons and $C_{10-30}$ hydrocarbyl ethers.

However, it will be appreciated that the present invention is not intended to be limited to any particular evaporation inhibitor. These and other evaporation inhibitors known to the person skilled in the art are, of course, within the ambit of the present invention.

The term "hydrocarbyl" (and equivalently "hydrocarbon") is used herein to refer to monovalent non-aromatic groups consisting generally of carbon and hydrogen. Hydrocarbyl groups thus include alkyl, alkenyl and alkynyl groups (in both straight and branched chain forms) and carbocyclic groups, as well as combinations of the foregoing, such as alkylcycloalkyl, alkylpolycycloalkyl etc. Unless specifically stated otherwise, the hydrocarbyl group may comprise one or more fluoro groups, including perfluorinated hydrocarbyl groups.

Experimental

A liquid composition containing an evaporation inhibitor (polyoxyethylene (2) stearyl ether) was prepared according to the formulation shown in Table 1. An otherwise identical liquid composition lacking the evaporation inhibitor was also prepared. Amounts are w

TABLE 1

Preparation of liquid compositions for comparative decap testing

| Component | Example 1 (wt. %) | Comparative Example 1 (wt. %) |
|---|---|---|
| Ethylene glycol | 10 | 10 |
| 2-pyrrolidone | 18 | 18 |
| Surfactants | 0.75 | 0.75 |
| Polyoxyethylene (2) stearyl ether | 0.2 | |
| Water | balance | balance |

In separate experiments, an uncapped Memjet® printhead was wiped with liquid compositions according to Example 1 and Comparative Example 1. After a predetermined number of minutes, the printhead was analysed by printing a proprietary decap diagnosis chart in order to assess the decap performance of the printhead. The results of decap testing are shown in Table 2.

TABLE 2

Decap testing of wiped printheads

| Decap test | 1 minute | 2 minutes | 3 minutes | 4 minutes | 5 minutes |
|---|---|---|---|---|---|
| Example 1 | pass | pass | pass | pass | pass |
| Comparative Example 1 | pass | pass | pass | fail | fail |

From the foregoing, it can be seen that wiping with the liquid composition containing an evaporation inhibitor significantly improves the decap performance of the printhead. Without wishing to be bound by theory, it is understood by the present inventors that the evaporation inhibitor forms a non-volatile film over inkjet nozzles, which inhibits evaporation of water and increases the decap time. Advantageously, this approach obviates the addition of relatively insoluble evaporation inhibitors into inkjet inks, thereby enabling a wider formulation window for inks.

It will, of course, be appreciated that the present invention has been described by way of example only and that modifications of detail may be made within the scope of the invention, which is defined in the accompanying claims.

The invention claimed is:

1. A method of inhibiting evaporation of water from inkjet nozzles of a printhead, the method comprising the steps of:

providing a wiping material infused with a liquid composition comprising an evaporation inhibitor; and wiping the wiping material over a nozzle plate of the printhead, wherein at least some of the evaporation inhibitor is transferred to the nozzle plate during wiping and thereby inhibits evaporation of water from the inkjet nozzles, wherein the evaporation inhibitor is selected from the group consisting of: $C_{10-30}$ hydrocarbons, $C_{10-30}$ perfluorinated hydrocarbons and $C_{10-30}$ perfluorinated hydrocarbyl ethers.

2. The method of claim 1, wherein the liquid composition comprises one or more ingredients selected from the group consisting of co-solvents and surfactants.

3. The method of claim 1, wherein the liquid composition is aqueous-based.

4. The method of claim 1, wherein the wiping material is comprised of a microfiber material.

5. The method of claim 1, wherein the wiping material is mounted on a printhead wiper.

6. The method of claim 1, wherein the wiping material is wiped longitudinally along the printhead or laterally across the printhead.

7. The method of claim 1, wherein the printhead is a pagewide printhead.

8. An apparatus for wiping a printhead comprising:

a carriage comprising a maintenance drum mounted thereon, the maintenance drum having a dispensing nozzle;

a web of wiping material having a wiping portion positioned over the dispensing nozzle;

a liquid container in fluid communication with the dispensing nozzle;

a dispensing system for dispensing liquid through the nozzle so as to infuse the portion of the wiping material with the liquid; and a carriage traversing mechanism for traversing the carriage longitudinally along the printhead so as to wipe the printhead and transfer the liquid onto the printhead, wherein the liquid comprises an evaporation inhibitor selected from the group consisting of: $C_{10-30}$ hydrocarbons, $C_{10-30}$ perfluorinated hydrocarbons and $C_{10-30}$ perfluorinated hydrocarbyl ethers.

9. The apparatus of claim 8, further comprising a web advancement mechanism for advancing the web past the dispensing nozzle.

* * * * *